US007552911B2

(12) United States Patent
Stark et al.

(10) Patent No.: US 7,552,911 B2
(45) Date of Patent: Jun. 30, 2009

(54) MULTIPART COMPOSITE VALVE FOR AN INTERNAL COMBUSTION ENGINE

(75) Inventors: Holger Stark, Tettnang (DE); Martin Schlegl, Rudersberg (DE)

(73) Assignee: Daimler AG, Stuttgart (DE)

( * ) Notice: Subject to any disclaimer, the term of this patent is extended or adjusted under 35 U.S.C. 154(b) by 442 days.

(21) Appl. No.: 10/570,030

(22) PCT Filed: Aug. 16, 2004

(86) PCT No.: PCT/EP2004/009171

§ 371 (c)(1),
(2), (4) Date: May 30, 2006

(87) PCT Pub. No.: WO2005/028818

PCT Pub. Date: Mar. 31, 2005

(65) Prior Publication Data

US 2006/0254553 A1 Nov. 16, 2006

(30) Foreign Application Priority Data

Aug. 29, 2003 (DE) ..... 103 40 320

(51) Int. Cl.
*F16K 1/48* (2006.01)

(52) U.S. Cl. ..... 251/368; 123/188.3; 29/888.45; 29/888.453; 137/375

(58) Field of Classification Search ..... 123/188.1, 123/188.3; 251/368; 137/375; 29/888.45, 29/888.453

See application file for complete search history.

(56) References Cited

U.S. PATENT DOCUMENTS

| | | | | |
|---|---|---|---|---|
| 2,037,340 | A * | 4/1936 | Rich | 123/188.3 |
| 5,076,866 | A * | 12/1991 | Koike et al. | 148/437 |
| 5,503,122 | A * | 4/1996 | Ritland et al. | 123/188.3 |
| 5,525,374 | A | 6/1996 | Ritland et al. | |
| 6,131,603 | A * | 10/2000 | Takano et al. | 137/375 |
| 6,263,849 | B1 * | 7/2001 | Bonesteel et al. | 123/90.51 |
| 6,453,867 | B1 * | 9/2002 | Ruhland et al. | 123/188.3 |
| 7,401,586 | B2 * | 7/2008 | Esswein et al. | 123/188.3 |
| 2003/0209218 | A1 * | 11/2003 | Baur et al. | 123/188.2 |

FOREIGN PATENT DOCUMENTS

| | | |
|---|---|---|
| EP | 0 296 619 A1 | 12/1988 |
| GB | 8417 | 4/1915 |

* cited by examiner

*Primary Examiner*—John Rivell
*Assistant Examiner*—Jeremy S Baskin
(74) *Attorney, Agent, or Firm*—Patent Central LLC; Stephen A. Pendorf

(57) ABSTRACT

A multipart composite valve for an internal combustion engine, in which a valve shaft (2) and a valve plate (4) are embodied separately while being joined together in an overlapping area (6). The invention is characterized in that at least some parts of the valve shaft (2) are provided with an intermediate layer (8) in the overlapping area (6). Said intermediate layer (8) forms an integral joint with both the valve shaft (2) and the valve plate (4) in the form of a chemical bond, the valve plate (4) being cast onto the valve shaft (2).

7 Claims, 2 Drawing Sheets

MULTIPART COMPOSITE VALVE FOR AN INTERNAL COMBUSTION ENGINE

CROSS REFERENCE TO RELATED APPLICATION

This application is a national stage of PCT/EP2004/009171 filed Aug. 16, 2004 and based upon German application DE 103 40 320.5 filed Aug. 29, 2003 under the International Convention.

BACKGROUND OF THE INVENTION

1. Field of Invention

The invention concerns a multi-part composite valve for an internal combustion engine.

In modern high power motors ever increasing demands are placed upon the high thermal loaded exhaust valves. The valve plate in particular is subjected to high mechanical and thermal loads. It has thus already been variously proposed to manufacture the value shaft and the valve plate of different materials and to join the two parts. Herein the valve shaft can be produced from a ductile material and the valve plate of a high temperature resistant and friction resistant material.

2. Related Art of the Invention

In DE 100 29 299 C2 a multi-part composite valve for an internal combustion engine as described, which as already discussed, is produced by joining a valve shaft and a valve plate. This invention is however particularly directed towards the objective of using a hollow valve shaft, which is cooled for example using sodium. Valve shaft and valve plate are joined to each other in this arrangement preferably by laser welding or by hard soldering or brazing. In this process however all individual parts must be separately manufactured and subsequently joined to each other in an elaborate joining device.

SUMMARY OF THE INVENTION

The task of the invention is comprised therein, of providing a multi-part composite valve for an internal combustion engine, which compared to the state-of-the-art requires less product steps and a less elaborate production facility.

The solution of this task is comprised in a valve for an internal combustion engine.

The multi-part composite valve for an internal combustion engine includes a valve shaft and a valve plate. Both are produced separately and joined to each other in an overlapping area. The invention is characterized in the valve shaft in the transition area at least partially is provided with an intermediate layer, and that this bonded with the valve shaft as well as with the valve plate materially in the manner of a chemical bond. Further, the valve plate is cast onto the valve shaft.

The term "chemical bonding" is herein understood to mean a material fused bond, wherein the material of the layers is bonded with each other by reaction, by alloying or by diffusion. A material-to-material bond of this type can also be achieved purely by casting the valve plate onto the shaft. The joining behavior is however in this method dependent upon the employed materials until now insufficient or unsatisfactory. The inventive employed intermediate layer is so designed, that it bonds both with the material of the valve shaft as well as with the material of the valve plate forming a substance bond. Therewith a solid and rigid bonding between the valve shaft and the valve plate is produced. Since the valve plate is cast on, a laborious welding and brazing process is no longer necessary.

Depending upon the character or composition of the materials of the valve shaft and the valve plate this can sometimes be useful, that the intermediate layer is in the form of a gradient layer or a multiple layer. In this manner the mechanical characteristics (for example hardness, modulus of elasticity), the physical characteristics (for example co-efficient of expansion, thermal conductivity) and the chemical characteristics of the individual partial areas, the valve plate and the valve shaft, be taken advantage of.

For supporting the substance-to-substance joining it can be useful that supplementally a form fitting joint between the valve shaft and the valve plate is provided. This form fitting joining can have a design such as for example microscopic cutbacks in transition area.

It can likewise be useful to thermally or mechanically roughen the valve shaft in the transition area for formation of microscopic undercuts or recesses. The term "microscopic undercuts or recesses" are herein intended to include microscopic surface recesses which are introduced for example by material erosion or material displacement. The liquid material of the cast on valve plate embeds itself in these microscopic surface recesses, solidifies and forms a solid tight form fitting or as the case may be material-to-material joint.

In a preferred manner the intermediate layer or a chemical precursor layer is provided, prior to the casting on of the valve plate, upon the transition are of the valve shaft. The term "chemical precursor layer" is herein understood to be a layer, which during the melting on of the valve plate or by a subsequent thermal treatment changes its chemical composition at least in part.

In one design of the invention the valve plate is comprised of a aluminum-titanium composite. For this as a rule a stoichiomutric titanium-aluminide (TiAl) is preferred. This material is comprised of an inter metallic fusion for composite of titanium and aluminum. It is exceptionally high temperature resistant and exhibits thereby a high mechanical and tribologic strength.

The valve shaft in comparison is in contrast preferably produced in advantageous manner from a steel material. Steels are known for advantageous properties and low price and exhibit a comparatively high ductility.

The intermediate layer or at least a tier or layer is preferably comprised of an alloy having a silver base, nickel base, titanium base and/or copper base. This type of alloys are suited for example as hard brazing or soldering, that can be applied easily upon the valve shaft in known coating processes and form together therewith on the surface an alloy, which in accordance with this invention is considered a chemical joint.

The at least one intermediate layer or the chemical precursor layer can likewise in preferred manner be comprised on the basis of a metal oxide. This metal oxide can undergo a reaction, in particular a reduction reaction, upon melting on of the alloy elements of the valve plate during the melting on thereof, which leads to a more solid chemical joining between the valve plate and the metal oxide of the intermediate layer.

That the intermediate layer or the chemical precursor layer prior to casting on of the valve plate exhibits an open porosity. This open porosity comprises between one percent and seventy five percent. Preferably this porosity is between 5% and 25% and between 30% and 60%. Therein in advantageous manner the liquid metal, which later forms the valve plate, can penetrate into the porosity of the intermediate layer and react along the surface thereof. By the incorporation of the porosity the surface, which is available for the joining between the valve plate and the intermediate layer, is increased. At the same time it can be useful to provide the surface of the intermediate layer analogous to the surface of the valve shaft with microscopic recesses or undercuts by mechanical or chemical processing.

The invention is in the following described in greater detail on the basis of a few selected working examples in conjunction with the attached drawings.

BRIEF DESCRIPTION OF THE DRAWINGS

Therein there is shown.

DETAILED DESCRIPTION OF THE INVENTION

Figure 1:
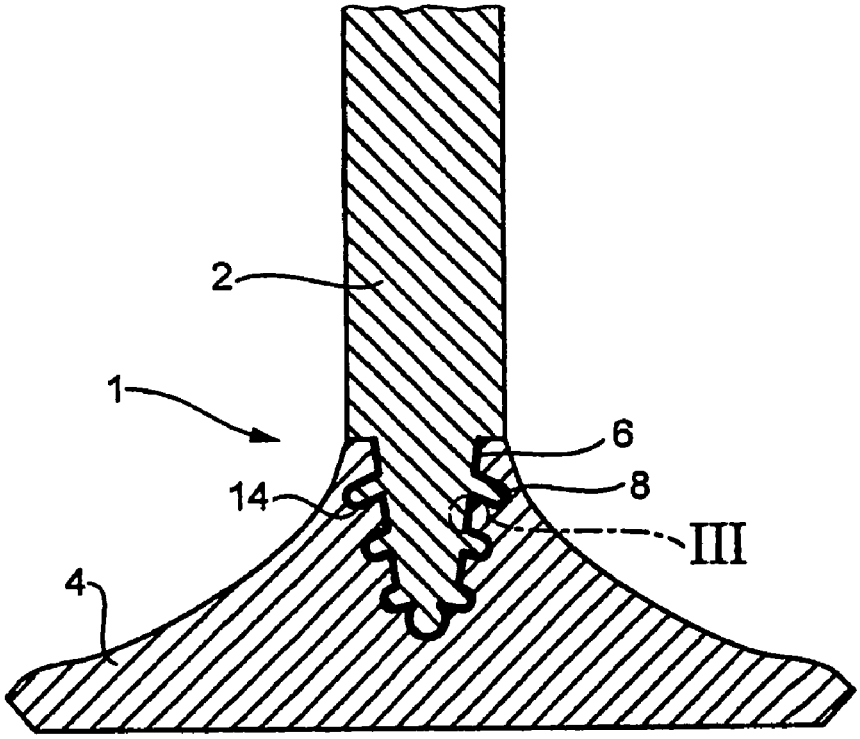
FIG. 1: a cross section through a valve with a valve shaft and a cast on valve plate, which in the transition area exhibits an intermediate layer.

In FIG. 1 the cross section through a valve 1 is schematically represented, wherein the valve 1 includes a valve shaft 2 and a valve plate 4. In a transition area 6 of the valve shaft 2 and the valve plate 4 the valve shaft 2 is provided with ring shaped undercuts 14. Besides this the valve shaft 2 exhibits in the overlapping area 6 and intermediate layer 8.

the valve plate is cast on the valve shaft 2. In the transition area 6 the valve plate 4 and the valve shaft 6 are materially joined to each other via the intermediate layer 8. For supporting the material-to-material bonding via the intermediate layer 8 the valve plate 4 and the valve plate shaft 2 are additionally form fittingly joined by the recesses 14 and therewith supplementally secured.

Figure 2:
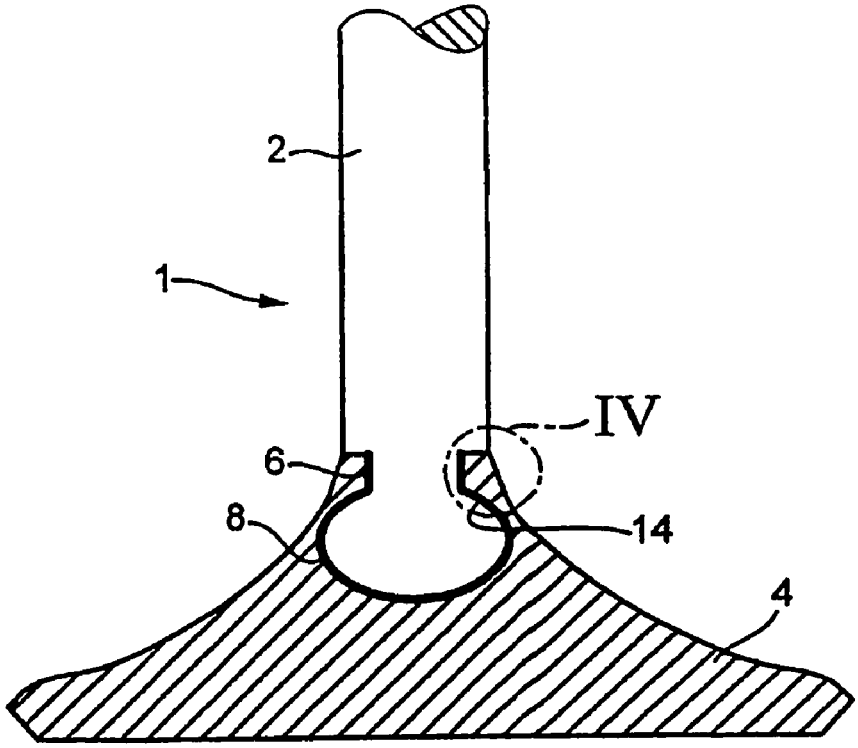
FIG. 2: a cross section through a valve with a valve shaft and a cast on valve plate, which in the transition area exhibits an intermediate layer.

In FIG. 2 an analogous representation of a valve 1 with a valve shaft 2 and a valve plate 4 is shown. Conceptually the same parts are given basically the same reference numbers. Also the valve 1 in FIG. 2 exhibits a recess 14 in the form of a sphere or a drop, which in the overlapping area 6 is fixed to the valve shaft 2. Likewise in this embodiment an intermediate layer 8 is provided, which joins the valve plate 4 and valve shaft 2 materially via chemical joining to each other.

The incorporation or introduction of recesses 14, which are shown in FIGS. 1 and 2, is for ensuring an optimal joining between the valve shaft 2 and the valve plate 4 not absolutely necessary however sometimes useful. In the recesses 14 in the FIGS. 1 and 2 these are basically two arbitrary examples. It is besides this conceivable that the recesses 14 are for example in a form of a spiral in the overlap area 6 of the valve shaft 2. For this all processes could be employed, which in conventional manner can be employed for producing a thread. Further, designs of recesses 14 in the overlap area 6 could be notches, grooves, corrugations, channels or bores.

It is further useful that the valve shaft 2 is treated in the overlap area 6 mechanically for example by sand blasting or by grit blasting. Thereby a surface roughness is increased in the overlap area 6, which improves the application and the attachment of the intermediate layer 8.

The intermediate layer 8 can basically be comprised of one or more functional layers. For this it follows that basically one or more different types of application process can be employed for the individual tiers or strata of the intermediate layer 8. Typical application processes are for example thermal spray processes such as plasma spraying, flame spraying, arc wire spraying or kinetic cold gas pacting. Further, thin coating techniques such as CVD, PVD or sputtering, painting and spray processes or galvanic processes can be employed. Further, the application of for example a metal alloy by a dip bath or by a soldering film, which is further melted in a soldering oven, conceivable.

As materials for the coating there come into consideration a high temperature resistant metal alloy, in particular based on silver, based on nickel, based on titanium, or based on copper. This type of alloy can also be employed as a hard solder or brazing solder are however applied in the present case for example by a thin layer technique or galvanic technique or by a dip bath or as the case may be by a later melted film coating upon the overlapping area 6. This type of alloys introduce upon the application of an external energy an alloy with the surface of the valve shaft 2. The alloy or amalgamate according to this, which by definition is considered as a chemical joint. Upon melting on of the valve plate 4 the materials alloy begin with the valve plate material, which is at this time in molten, at least however in softened form, and forms therewith a chemical joint in the form of an alloy or in the form of intermetallic phases.

A further variant of layer materials comprises the application of reactive metal compounds for example metal oxides. This type of metal oxide can be produced for example by a thermal spray process or by laser centering of an applied ceramic slip. This type of thermal spray process is particularly economic from a production technology perspective. As an example for a suitable metal oxide one could name titanium oxide (TiO2). In the use of a valve plate material on the basis of TiAl the TiO2 undergoes a exothermic chemical reaction with the aluminum of the TiAl melt. The chemical reaction proceeds according to the following equation: "x TiO2+y Al+Ti->A12o3+TiaAlb."

The provided reaction equation is not stoiciometrically. It is however noted that by the nickel reaction the molten aluminum is drawn upon for formation of the aluminum oxide. For ensuring a stoiciometric composition of the valve plate 4 on the basis of Ti:Al=1:1, it is preferred to supply in the melt and stoiciometric excess of aluminum.

The reaction product titanium oxide and TiaAlb, which forms the intermediate layer 8 according to this reaction, forms a homogonous dense layer, which chemically is joined with the valve plate 4. By the exothermic energy, which is released during the above mentioned reaction, also a surface reaction with the surface of the valve shaft 2 occurs. The thermal sprayed or as the case may be laser centered metal oxide can be considered as a chemical precursor layer for the intermediate layer 8.

The above explanations basically are intended to represent one example of a reaction system, by means of which a chemical bound transition layer 8 is producible. Basically all further reaction systems, which undergo an exothermic reaction with the melt material of the valve plate 4 can be employed as the basement material and chemical precursor layer for the transition layer 8. These include for example also the carbides, nitrides and borides of the adjacent metal.

Basically, after the casting on of the valve plate 4 onto the valve shaft 2 a further thermal treatment can occur, which can serve to support the formation of a chemical bonding between the intermediate layer 8 on the one hand and the valve plate 4 or as the case may be the valve shaft 2.

Figure 3:
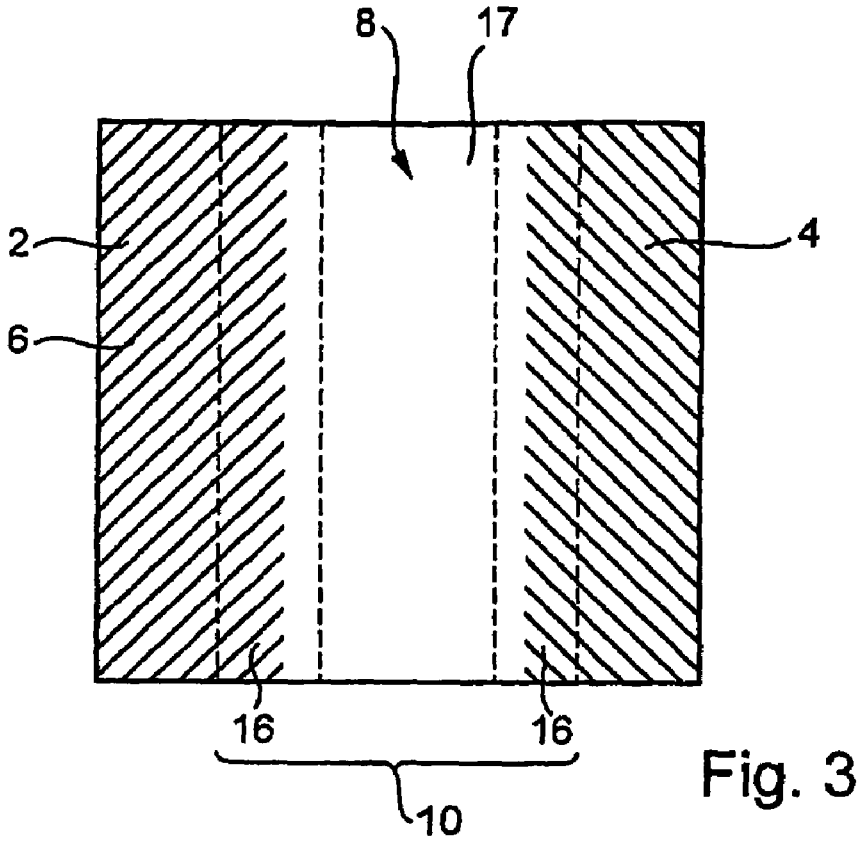
FIG. 3: an enlargement of the detail III from FIG. 1 with the schematic representation of an intermediate layer in the form of a gradient layer.
Figure 4:
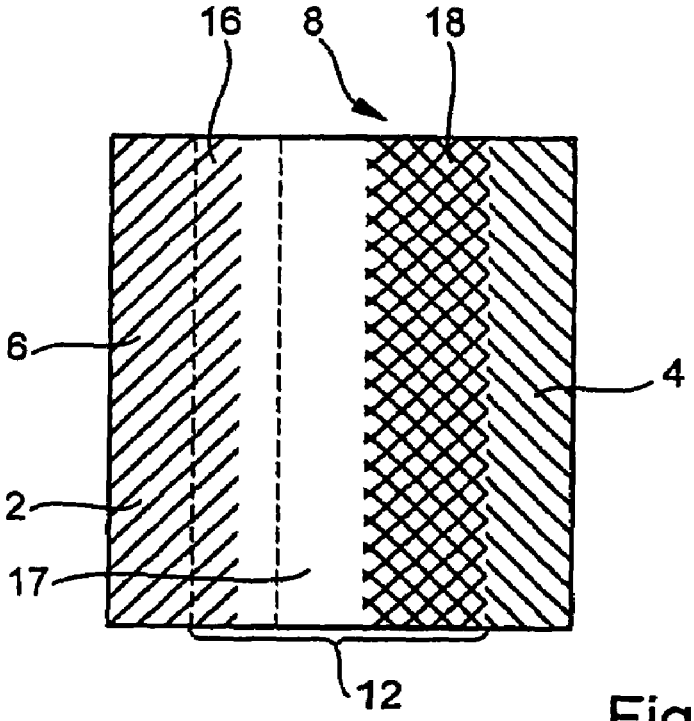
FIG. 4: an enlarged representation of the detail IV of FIG. 2, a schematic representation of an intermediate layer in the form of a multiple layer.

For ensuring a balance of the various physical material characteristics of the valve shaft material and the valve plate material, it can be useful to utilize a multi-strata layer 12 (FIG. 4) or a gradient layer 10 (FIG. 3) as the transition layer 6. Herein reference can be made back to the already described base principles of the types of application of the layer materials and their manner of reaction. In FIGS. 3 and 4 illustrative examples for a gradient layer 10 or as the case may be for a multi-strata layer 12 are shown.

In FIG. 3 a gradient type transition layer 6 is shown, which is based for example on the basis of a high temperature solder AgCu 13. The solder material AgCu 13 is applied in a dip bath upon the overlap area 6 of the valve shaft 2. But the energy exhibited by the liquid melt, the chemical reaction in the form of an alloying occurs in area 16. This is a superficial alloying of the steel of the valve shaft 2 and the AgCu 13 alloy. In FIG. 3 this area is indicated bordered by two dashed lines and schematically by a decreasing gray area, During the melting on of the valve plate 4 in turn so much thermal energy from the melt is applied, to the AgCu 13 layer material undergoes an alloying with the TiAl material of the valve plate 4. Also here there results a gradient shaped transition area 16 in which the individual alloy components are present in the form of intermetallic phases or in the form of alloy. As further layer composition the material of the valve plate 4 continues in pure form.

A further useful alloying system is comprised on the basis of nickel and exhibits for example the following composition: 7 wt. % Cr, 3 wt. % Fe, 4, 5 wt. % Si, 3, 2 wt. % B as well as Rest Nickel.

The chrome content of this alloy can be varied between 7 wt. % and 19 wt. %, the silicon coating can vary between 4.5 wt. % and 7.5 wt. %.

The material is preferably applied in the form of a film or foil and melted in the overlap area 6 of the valve shaft 2.

If a chemical bonding of the shaft material and plate material can not be ensured by a bonding alloy, as indicated for example in the form of AgCu 13, then it can be useful, analogous to FIG. 4 to apply a further supplemental layer 18 in the form of thermal spray layer of titanium oxide.

The intermediate layer 8 from FIG. 4 is in the form of a multi-strata layer 12. Herein analogous to FIG. 3 first in the overlap area 6 of the valve shaft 2 a metallic alloy, in this case by galvanic coating, is applied, upon which next a titanium oxide layer can be applied by thermal spray processes, in this case by an arc wire spraying. The galvanic application method there forms between the material of the valve shaft 2 and the galvanic applied alloy material 17 an alloy in the form of a solid rigid chemical bond. The thermal spray layer 18, which essentially is comprised of a titanium oxide, exhibits a porosity, which can be adjusted by process parameters, is 55%. During melting on of the valve plate 4 the liquid TiAl material is drawn by capillary forces into the pores of the porous layer 18, or upon this leads to an exothermic reaction to the above provided reaction equation. In the area of the layer 18 there forms in accordance with the reaction an aluminum oxide/TiAl material, which is solidly chemically bonded with the TiAl material of the valve plate 4. In the intermediate layer 8 shown in FIG. 4 there is represented a combination of a multi-strata layer 12 and a gradient layer 10. This complex construction is suited for balancing the physical and mechanical characteristics between the valve shaft material and the valve plate material. This includes in particular the thermal co-efficient of expansion. However also electrochemical characteristics can make it necessary to employ the multiple layers. By the application of a thermal sprayed layer it is possible also to influence the surface structure of the layer for example. By adjusting the spray parameters a suitably roughened surface can be adjusted for the melting on of the valve plate 4.

The invention claimed is:

1. A multi-part composite valve (1) for an internal combustion engine, wherein a steel valve shaft (2) and a Ti—Al valve plate (4) are separately produced and joined to each other in an overlap area (6), wherein the valve plate (4) is cast on-to the valve shaft (2), and wherein the valve shaft (2) in the overlap area (6) is provided, prior to the casting-on, at least partially with at least one intermediate layer (8) comprised of an Ag-base alloy and/or Ni-base alloy and/or Cu-base alloy or is constituted on the basis of a metal oxide, which subsequent to the casting-on is material-to-material bonded both to the valve shaft (2) and the valve plate (4) in the manner of a chemical bond.

2. The valve according to claim 1, wherein the intermediate layer (8) is in the form of a gradient layer (10) or multi-strata layer (12).

3. The valve according to claim 1, wherein the valve shaft (2) in the overlap area (6) exhibits macroscopic undercuts or recesses (14).

4. The valve according to claim 1, wherein the valve shaft (2) is mechanically or chemically roughened in the overlap area (6) for formation of microscopic undercuts or recesses (14).

5. The valve according to claim 1, wherein the at least one intermediate layer (8) comprises an Ag-based alloy and/or Ni-based alloy and/or Ti-based alloy and/or a Cu-based alloy.

6. The valve according to claim 1, wherein the at least one intermediate layer (8) is constituted on the basis of a metal oxide.

7. The valve according to claim 1, wherein the intermediate layer (8) prior to casting-on of the valve plate (4) exhibits an open porosity of between 1% and 75%.

* * * * *